US012403367B2

(12) United States Patent
LeDoux

(10) Patent No.: US 12,403,367 B2
(45) Date of Patent: Sep. 2, 2025

(54) TRAINING BAT

(71) Applicant: Axis Sports LLC, Fall River, MA (US)

(72) Inventor: Louis A. LeDoux, Fall River, MA (US)

(73) Assignee: Axis Sports LLC

( * ) Notice: Subject to any disclaimer, the term of this patent is extended or adjusted under 35 U.S.C. 154(b) by 0 days.

(21) Appl. No.: 18/063,074

(22) Filed: Dec. 7, 2022

(65) Prior Publication Data

US 2023/0173364 A1 Jun. 8, 2023

Related U.S. Application Data

(60) Provisional application No. 63/287,134, filed on Dec. 8, 2021.

(51) Int. Cl.

| | |
|---|---|
| ***A63B 69/00*** | (2006.01) |
| ***A63B 59/55*** | (2015.01) |
| *A63B 102/18* | (2015.01) |

(52) U.S. Cl.

CPC ..... *A63B 69/0002* (2013.01); *A63B 59/55* (2015.10); *A63B 2069/0008* (2013.01); *A63B 2102/18* (2015.10); *A63B 2102/182* (2015.10)

(58) Field of Classification Search

CPC ..... A63B 2102/182; A63B 2069/0008; A63B 69/0002; A63B 59/55

USPC ..... 473/457, 564

See application file for complete search history.

(56) References Cited

U.S. PATENT DOCUMENTS 3,104,876 A * 9/1963 Salinger ..... A63B 59/50 473/568
3,618,945 A 11/1971 Kuchar
3,880,423 A * 4/1975 Kreag ..... A63B 59/51 473/566
4,445,687 A * 5/1984 Merritt ..... A63B 59/50 473/564
4,930,772 A * 6/1990 Maloney ..... A63B 59/20 473/457
6,045,465 A 4/2000 Alfano et al.
6,565,462 B1 * 5/2003 Gregg ..... A63B 69/0002 473/422

(Continued)

FOREIGN PATENT DOCUMENTS

JP 3159923 U 6/2010

OTHER PUBLICATIONS

"International Search Report and Written Opinion received for PCT Patent Application No. PCT/US2023/067233, mailed on Sep. 8, 2023", 7 pages.

*Primary Examiner* — Mitra Aryanpour
(74) *Attorney, Agent, or Firm* — Adler Pollock & Sheehan P.C.

(57) ABSTRACT

A bat configured to improve batting skills during practice and training. The bat includes a body extending between first and second ends of the bat and including opposed first and second ball-contacting surfaces and first and second cutout portions of the bat body formed along a length thereof and forming a wedge therebetween. The wedge extends between the first and second ball-contacting surfaces. The cutout portions include respective flat machined surfaces forming opposing sides of the wedge. The bat body defines a longitudinal axis, and the wedge is formed such that the flat machined surfaces each form an acute angle with an imaginary reference line that is perpendicular to the longitudinal axis.

19 Claims, 4 Drawing Sheets

(56) References Cited

U.S. PATENT DOCUMENTS

| | | | | |
|---|---|---|---|---|
| 6,923,738 | B1 * | 8/2005 | Fulp | A63B 69/0002 473/457 |
| D543,251 | S * | 5/2007 | Kelliher | D21/725 |
| D640,339 | S | 6/2011 | Goldenthal | |
| D652,879 | S * | 1/2012 | Vigness | D21/725 |
| D803,331 | S * | 11/2017 | Santorelli | D21/725 |
| 2007/0219027 | A1 * | 9/2007 | Chong | A63B 59/50 473/457 |
| 2008/0081711 | A1 | 4/2008 | Chauvin et al. | |
| 2008/0113832 | A1 | 5/2008 | Ciesar et al. | |
| 2010/0311525 | A1 * | 12/2010 | Cornford | A63B 59/55 473/457 |
| 2011/0224033 | A1 | 9/2011 | Wabnitz | |
| 2015/0251069 | A1 * | 9/2015 | Tekerman | A63B 15/00 473/457 |
| 2015/0273305 | A1 | 10/2015 | Haro | |
| 2023/0048415 | A1 * | 2/2023 | Richards | A63B 69/0002 473/457 |
| 2023/0173364 | A1 * | 6/2023 | LeDoux | A63B 59/55 473/457 |

* cited by examiner

TRAINING BAT

RELATED APPLICATION

This application claims the benefit of priority to U.S. Provisional Patent Application No. 63/287,134, filed Dec. 8, 2021, the disclosure of which is incorporated by reference herein in its entirety.

FIELD OF THE INVENTION

The invention relates to athletic equipment, and more particularly, to bats for baseball and softball.

BACKGROUND OF THE INVENTION

Bats are used in baseball, softball and other athletic activities. It is desirable to have a bat specifically modified for practicing swings of the bat, which provides instant feedback to a user thereof, while also preventing injuries to a user's wrists.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In one aspect, a bat is provided, and includes a first end having a handle portion, a second end opposite the first end, a bat body extending between the first and second ends and including opposed first and second ball-contacting surfaces, and first and second cutout portions of the bat body formed along a length thereof and forming a wedge therebetween. The wedge extends between the first and second ball-contacting surfaces. The first cutout portion includes a first flat machined surface forming a first side of the wedge, and the second cutout portion includes a second flat machined surface forming a second side of the wedge. The bat body defines a longitudinal axis, and the wedge is formed such that the first flat machined surface forms a first acute angle with a first imaginary reference line that is perpendicular to the longitudinal axis.

In another aspect, a bat is provided, and includes a first end having a handle portion, a second end opposite the first end, a bat body extending between the first and second ends and including at least one ball-contacting surface; and at least one cutout portion of the bat body formed along a length thereof and including at least one flat machined surface. The at least one flat machined surface forms a wedge. The at least one cutout portion may include a first cutout portion and a second cutout portion, the at least one flat machined surface may include a first flat machined surface within the first cutout portion and a second flat machined surface within the second cutout portion. The first flat machined surface forms a first side of the wedge, and the second flat machined surface forms a second side of the wedge. The bat body defines a longitudinal axis, and the wedge is formed such that the first flat machined surface forms a first acute angle with a first imaginary reference line that is perpendicular to the longitudinal axis.

BRIEF DESCRIPTION OF THE DRAWINGS

Embodiments of the invention are further described but are in no way limited by the following illustrations.

DETAILED DESCRIPTION OF THE INVENTION

Figure 1:
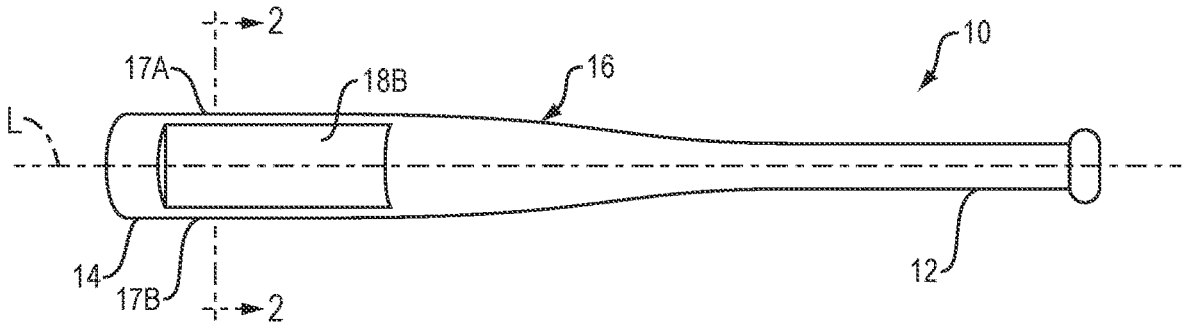
FIG. 1 is a front elevation view of a training bat according to an embodiment of the invention.

For convenience, the meaning of some terms and phrases used in the specification, examples, and appended claims, are provided below. Unless stated otherwise, or implicit from context, the following terms and phrases include the meanings provided below. The definitions are provided to aid in describing particular embodiments, and are not intended to limit the claimed invention, because the scope of the invention is limited only by the claims. Unless otherwise defined, all technical and scientific terms used herein have the same meaning as commonly understood by one of ordinary skill in the art to which this invention belongs. If there is an apparent discrepancy between the usage of a term in the art and its definition provided herein, the definition provided within the specification shall prevail.

As used in this specification and the appended claims, the singular forms "a," "an" and "the" include plural referents unless the content clearly dictates otherwise.

As used herein, the term "approximately" or "about" in reference to a value or parameter are generally taken to include numbers that fall within a range of 5%, 10%, 15%, or 20% in either direction (greater than or less than) of the number unless otherwise stated or otherwise evident from the context (except where such number would be less than 0% or exceed 100% of a possible value). As used herein, reference to "approximately" or "about" a value or parameter includes (and describes) embodiments that are directed to that value or parameter. For example, description referring to "about X" includes description of "X".

As used herein, the term "or" means "and/or." The term "and/or" as used in a phrase such as "A and/or B" herein is intended to include both A and B; A or B; A (alone); and B (alone). Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

As used herein, the term "comprising" means that other elements can also be present in addition to the defined elements presented. The use of "comprising" indicates inclusion rather than limitation.

The term "consisting of" refers to compositions, methods, and respective components thereof as described herein, which are exclusive of any element not recited in that description of the embodiment.

Disclosed herein is a training bat for use by athletes who are training for baseball, softball and other sports in which a bat is used.

An embodiment of the training bat according to the present invention is shown in FIGS. 1-5. The training bat 10 includes a first end 12 having a handle portion, a second end 14 opposite the first end 12 and a bat body 16 that extends between first and second ends 12, 14, and includes opposed first and second ball-contacting/hitting surfaces 17A and 17B. A longitudinal axis L extends along the bat body 16, including the first and second ends 12, 14.

The training bat 10 further includes one or more portions 18A, 18B of the bat body 16 that is/are cut out and form a wedge 20 therebetween. As further explained below, at least one surface of the wedge 20 is formed at an acute angle A with an imaginary reference line RL that is perpendicular to the bat's longitudinal axis L. In a preferred embodiment, the acute angle A is 17 degrees. Other angle measurements for acute angle A are also possible and within the scope of the present invention.

Figure 2:
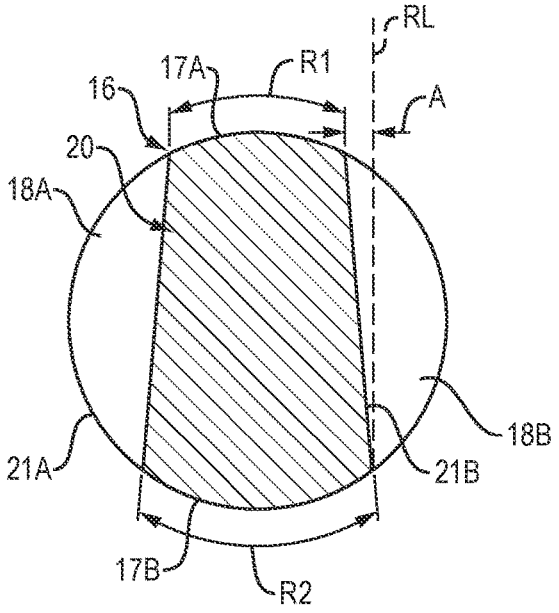
FIG. 2 is a cross-section view of the training bat of FIG. 1 taken along line A-A.
Figure 3:
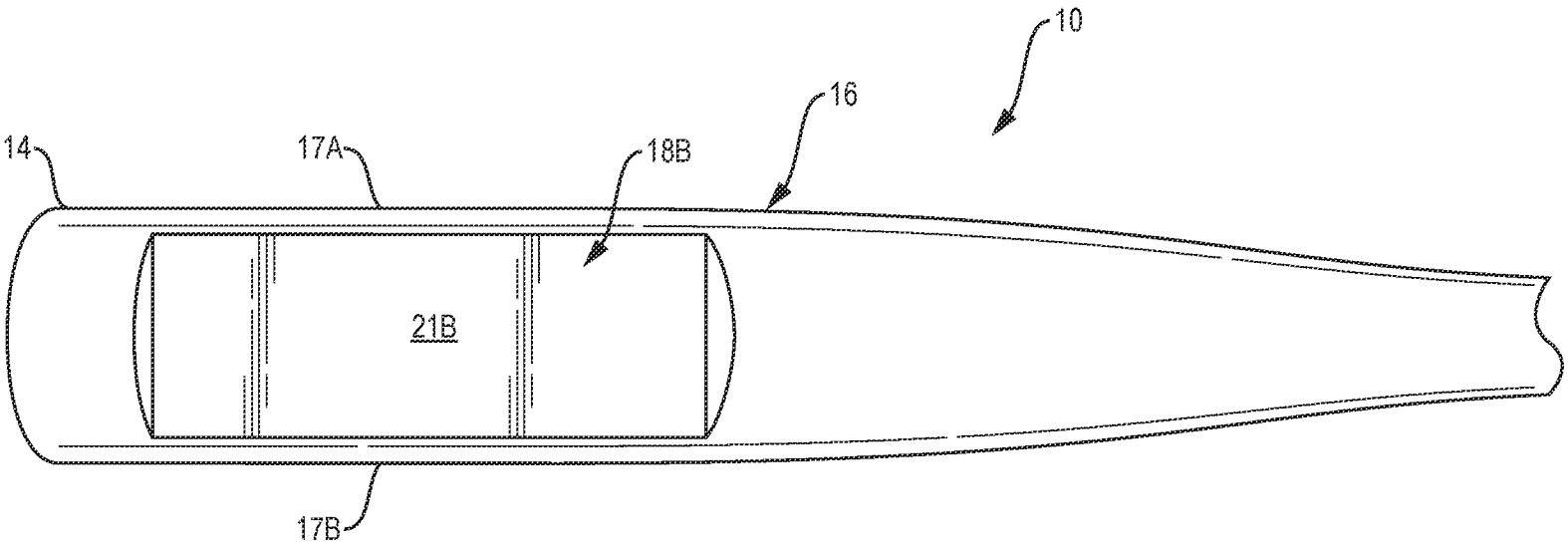
FIG. 3 is a photograph showing a front elevation view of the training bat of FIG. 1.
Figure 4:
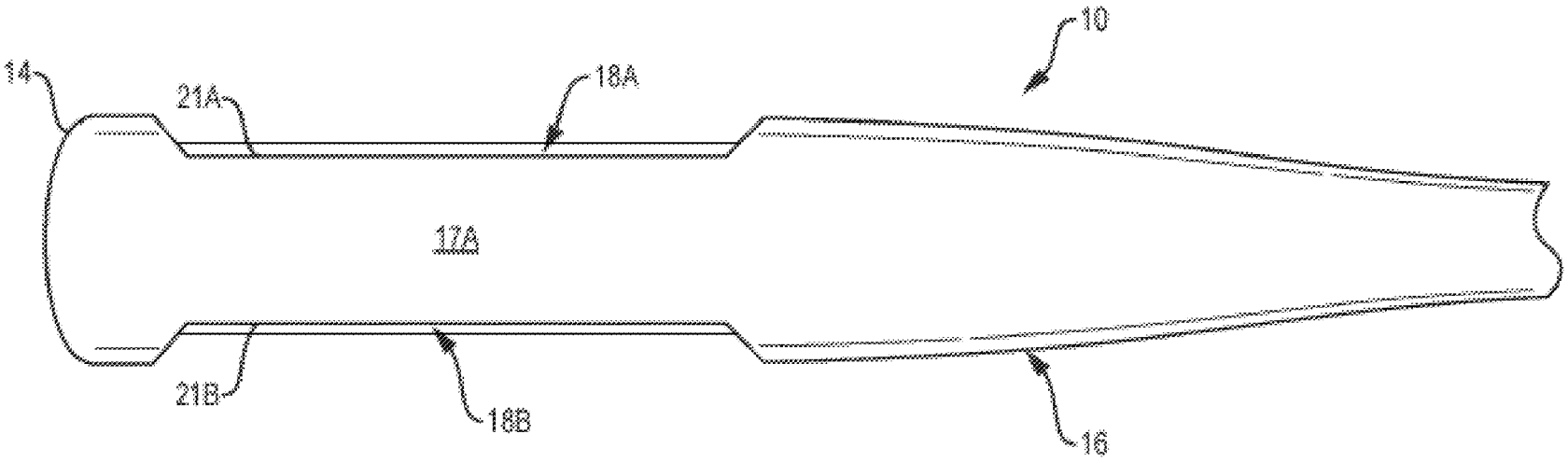
FIG. 4 is a photograph showing a side elevation view of the training bat of FIG. 1.
Figure 5:
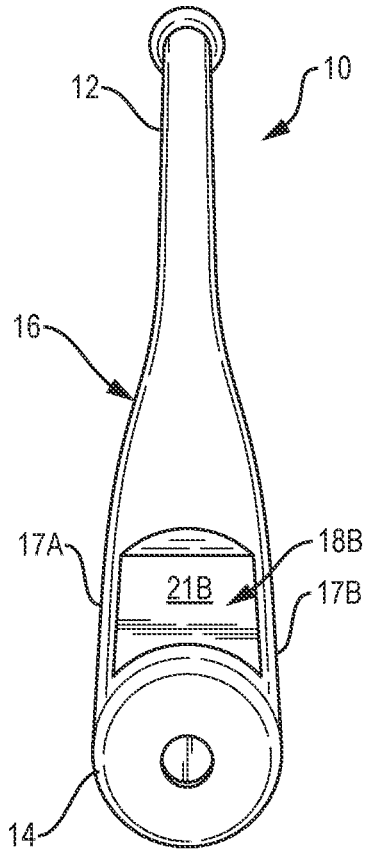
FIG. 5 is a photograph showing an end view of the training bat of FIG. 1.

The training bat 10 illustrated in FIGS. 1-5 show a bat body 16 that includes two cutout portions 18A, 18B that are formed proximate the second end 14 of the training bat 10, and on opposite sides of the bat body 16. The cutout portions 18A, 18B are formed on opposite sides of the bat body 16 so that the wedged training bat 10 can be used by both right-handed and left-handed hitters. The cutout portions 18A, 18B include opposed flat machined surfaces 21A, 21B, respectively. The flat machined surfaces 21A, 21B form the wedge 20 between them. The first flat machined surface 21A is formed at a first acute angle A to a first imaginary reference line RL that is perpendicular to the bat's longitudinal axis L, as shown in FIG. 2. The second flat machined surface 21B is formed at a second acute angle to a second imaginary reference line that is also perpendicular to the bat's longitudinal axis L. In the embodiment shown in FIG. 2, the second imaginary reference line and the second acute angle are not illustrated, but they constitute a mirror image of the first imaginary reference line RL and first acute angle A, respectively, i.e., with the same values.

The flat machined surfaces 21A, 21B of the two cutout portions 18A, 18B forming the wedge 20 are separated from each other by a first arc R1 that corresponds to the first ball-contacting/hitting surface 17A, and a second arc R2 that corresponds to the second ball-contacting/hitting surface 17B. In one embodiment, first arc R1 has a length of 1.375" and second arc R2 has a length of 1.625". Other arc lengths are also possible and within the scope of the present invention. Such arc lengths vary depending on the diameter and barrel of the bat body 16.

In various other embodiments, the bat body 16 includes other numbers of cutout portions and wedges, including, but not limited to, one, three and four cutout portion(s)/wedge (s).

The cutout portions 18A, 18B are formed by machining the bat body 16. In one embodiment, the bat body 16 is positioned on a Bridgeport machine with a cutter that is custom designed to make the cutout portions 18A, 18B therein. The bat body 16 is secured in place on the Bridgeport machine and a first cut is made on one side thereof to form the first cutout portion 18A, with the first flat machined surface 21A thereof at acute angle A (e.g., 17 degrees) with the imaginary reference line RL (see FIG. 2). The bat body 16 is then rotated 180 degrees to make the same cut on the other, opposite side thereof to form the second cutout portion 18B, with the second flat machined surface 21B thereof at the same acute angle (e.g., 17 degrees) with another imaginary reference line (now shown) that is also perpendicular to the bat's longitudinal axis L (i.e., as a mirror image of the imaginary reference line RL).

In various embodiments, the lengths of the cutout portions 18A, 18B and their respective flat machined surfaces 21A, 21B along the bat body 16 depend on the total length of the bat body 16 and range from 4" to 6". Other cutout portion lengths are also possible and within the scope of the present invention.

The configuration of the training bat 10 helps a user (i.e., athlete/player) avoid rolling his or her wrists while practicing bat swinging and other batting training exercises. If the user rolls their wrists too soon, before making contact between the training bat 10 and a ball, they will hit one of the flat machined surfaces 21A, 21B of the cutout portions 18A, 18B, respectively (i.e., on either side of the wedge 20), which will make the trajectory of the ball coming off the flat portion shoot up in the air, and thereby instantly let the user know that they have taken the wrong path to hit the ball. The cutout portions 18A, 18B thereby allow a user to know when they have executed an improper swing technique, providing instant feedback upon the swing. When the user hits the ball correctly, i.e., with the first or second ball-contacting/hitting surface 17A, 17B on either end of the wedge 20, the ball projects out as if hit by a regular/non-machined bat. The flat machined surfaces 21A, 21B of the cutout portions 18A, 18B, respectively, show the user where they should hit the ball, i.e., the "sweet spot".

The training bat 10 keeps the user's hands in the proper "palms up, palms down" position at the point of contact.

The training bat 10 is configured so that when a user holds the training bat 10 (i.e., by the handle at the first end 12) it feels like a regular/non-machined bat, which enhances a user's training experience.

In general, any combination of disclosed features, components and methods described herein is possible. Steps of a method can be performed in any order that is physically possible.

Although embodiments have been disclosed, the invention is not limited thereby.

I claim:

1. A bat comprising:

a first end having a handle portion;

a second end opposite the first end;

a bat body extending between first and second ends and includes a longitudinal axis a first ball-hitting surface and a second ball-hitting surface are positioned on opposite sides of the bat body from each other along the longitudinal axis of the bat body located proximal to the second end, and are separated by a first recessed cut-out (1RCO) portion and a second recessed cut-out (2RCO) portion which are positioned on opposite sides of the bat body from each other; and a total length of a circumference of the bat body located proximal to the second end is equal to a sum of arcs including, a length of an arc of R1 for the first ball-hitting surface, a length of an arc of 1RCO portion, a length of an arc of R2 for the second ball-hitting surface, and a length of an arc of 2RCO portion, wherein the arc length of R1 is less than the arc length of R2, such that an amount of a difference that the arc length of R1 is less than the arc length of R2 is determined based upon a length of a diameter of the bat body and a length of a barrel of the bat body.

2. The bat of claim 1, wherein the 1RCO portion includes a first flat machined surface, and the 2RCO portion includes a flat machined surface.

3. The bat of claim 2, wherein the first flat machined surface of the 1RCO portion forms a first acute angle with a first imaginary reference line that is perpendicular to the longitudinal axis.

4. The bat of claim 3, wherein the first acute angle is 17 degrees.

5. The bat of claim 3, wherein the second flat machined surface of the 2RCO portion forms a second acute angle with a second imaginary reference line that is perpendicular to the longitudinal axis, such that the second acute angle and the second imaginary reference line constitute a mirror image of the first imaginary reference line and first acute angle, respectively, with the same values.

6. The bat of claim 2, wherein the first and the second flat machined surfaces are separated from each other by the arc length of R1 for the first ball-contacting surface and the arc length of R2 for the second ball-contacting surface.

7. The bat of claim 6, wherein the arc length of R1 is 1.375".

8. The bat of claim 6, wherein the arc length of R2 is 1.625".

9. The bat of claim 1, wherein the opposing first and second ball-hitting surfaces are configured to assist rolling wrists of a user while practicing bat swinging and other batting training exercises, and to keep hands of the user in a proper "palms up, palms down" position at a point of contact with a ball or similar like object.

10. The bat of claim 1, wherein the 1RCO and the 2RCO portions each have a length in a range from 4" to 6".

11. A training bat comprising:

a first end having a handle portion;

a second end opposite the first end;

a bat body extending between first and second ends and includes a longitudinal axis; and a first ball-hitting surface and a second ball-hitting surface are positioned on opposite sides of the bat body from each other along the longitudinal axis of the bat body located proximal to the second end, and are separated by a first recessed cutout (1RCO) portion and a second recessed cutout (2RCO) portion having at least one flat machined surface, wherein the first ball-hitting surface has a length of an arc of R1 that is less than the second ball-hitting surface having a length of an arc of R2 that is along a circumference of the bat body located proximal to the second end.

12. The training bat of claim 11, wherein the at least one RCO portion wherein the at least one flat machined surface includes a first flat machined surface within the 1RCO portion and a second flat machined surface within 2RCO portion.

13. The training bat of claim 12, wherein the first flat machined surface of the 1RCO portion forms a first acute angle with a first imaginary reference line that is perpendicular to the longitudinal axis.

14. The training bat of claim 13, wherein the first acute angle is 17 degrees.

15. The training bat of claim 12, wherein the 1RCO and the 2RCO portions are formed on opposite sides of the bat body opposing the first and the second ball-hitting surfaces, resulting in a structure of the bat that assists avoiding wrists of a user from rolling while practicing bat swinging and other batting exercises, and keep hands of the user in a proper palms up, palms down position, when the bat at a point of contact with a ball or similar like object.

16. The training bat of claim 11, wherein an amount of a difference in a length of the arc length of R1 that is less than the arc length of R2 is determined based upon a length of a diameter of the bat body and a length of a barrel of the bat body.

17. The training bat of claim 11, wherein the at least one RCO portion is positioned on at least one side of either the first ball-hitting surface or the second ball-hitting surface along the longitudinal axis of the bat body located proximal to the second end.

18. A multi-user bat comprising:

a first end having a handle portion;

a second end opposite the first end;

a bat body extending between first and second ends and includes a longitudinal axis; and a first ball-hitting surface and a second ball-hitting surface positioned along the longitudinal axis of the bat body located proximal to the second end, and separated by a first recessed cut-out (1RCO) portion and a second recessed cut-out (2RCO) portion which are positioned on opposite sides of the bat body from each other, wherein the first ball-hitting surface has a length of an arc of R1 that is less than the second ball-hitting surface having a length of an arc of R2 that is along a circumference of the bat body located proximal to the second end;

wherein the 1RCO portion includes a first flat machined surface forming a first acute angle with a first imaginary reference line that is perpendicular to the longitudinal axis that is connected to at least surface, and the 2RCO portion includes a second flat machined surface forming a second acute angle to a second imaginary reference line that is perpendicular to the longitudinal axis that is connected to at least surface, and wherein the first and second flat machined surfaces are separated from each other by the arc length of R1 that corresponds to the first ball-hitting surface and the arc length of R2 that corresponds to the second ball-hitting surface.

19. The multi-user bat of claim 18, wherein an amount of a difference in a length that the arc length of R1 is less than the arc length of R2 is determined based upon a length of a diameter of the bat body and a length of a barrel of the bat body.

* * * * *